United States Patent [19]

Mikawa

[11] Patent Number: 5,041,176

[45] Date of Patent: Aug. 20, 1991

[54] PARTICLE DISPERSION-STRENGTHENED COPPER ALLOY

[75] Inventor: Tsuneaki Mikawa, Tokyo, Japan

[73] Assignee: Japan Mikaloy Co., Ltd., Tokyo, Japan

[21] Appl. No.: 589,755

[22] Filed: Sep. 28, 1990

[30] Foreign Application Priority Data

Sep. 29, 1989 [JP] Japan ..... 1-251765

[51] Int. Cl.[5] ..... C22C 9/02; C22C 9/06

[52] U.S. Cl. ..... 148/412; 148/414; 420/473

[58] Field of Search ..... 420/473, 487, 490; 148/412, 414, 433, 435

[56] References Cited

U.S. PATENT DOCUMENTS 2,129,197 9/1938 Bryant ..... 420/473

3,392,017 7/1968 Quaas et al. ..... 148/433

4,818,307 4/1989 Mori et al. ..... 148/414

*Primary Examiner*—R. Dean

*Assistant Examiner*—George Wyszomierski

*Attorney, Agent, or Firm*—Armstrong, Nikaido, Marmelstein, Kubovcik & Murray

[57] ABSTRACT

A particle dispersion-strengthened copper alloy consisting essentially of copper as the main component, 0.1–10% by weight of nickel, 0.1–10% by weight of tin, 0.05–5% by weight of silicon, 0.01–5% by weight of iron, and 0.0001–1% by weight of boron. The alloy is suitable for use in electronic parts due to its good electrical conductivity, heat conductivity, strength, hardness, plating ability, soldering ability, elasticity, and excellent corrosion resistance including resistance to acids.

7 Claims, No Drawings

PARTICLE DISPERSION-STRENGTHENED COPPER ALLOY

This invention relates to a particle dispersion-strengthened copper alloy.

SUMMARY OF THE INVENTION

An object of the invention is to provide a dispersion-strengthened copper alloy, which is particularly suitable for the manufacture of electronic parts because it is characterized by the following properties: good electrical conductivity, heat conductivity, strength, hardness, plating ability, soldering ability, elasticity, and excellent corrosion resistance including resistance to acids.

Another object of the invention is to provide a copper alloy which retains its strength even after continuous exposure to high temperatures.

DETAILED DESCRIPTION OF THE INVENTION

The particle dispersion-strengthened copper alloy of this invention comprises, in addition to copper which is the main component, 0.1–10% by weight of nickel, 0.1–10% by weight of tin, 0.05–5% by weight of silicon, 0.01–5% by weight of iron, and 0.0001–1% by weight of boron.

The copper alloy of this invention is characterized by the presence of a Ni-Si intermetallic compound which is homogeneously dispersed in the alloy and imparts greater strength and electrical conductivity to the alloy.

In general, the Young modulus is decreased when another element is added to copper. However, nickel and copper form a solid solution when mixed in any proportions, and the addition of nickel to copper results in an increase in the Young modulus.

When tin is added to a Cu-Ni alloy, a spinodal Cu-Ni-Sn alloy is obtained. This spinodal alloy is characterized by a separation of the single phase-alloy into two fine phases having low free energy. The spinodal separation has the effect of increasing the strength of the alloy, particularly its tensile strength.

The addition of Si to a spinodal Cu-Ni-Sn alloy results in the formation of a homogeneous dispersion of Ni-Si intermetallic compound in the $\alpha$-matrix of the alloy. The presence of this dispersion of particles gives high strength and improved electrical conductivity to the alloy.

The addition of iron improves the mechanical properties of the alloy upon heat treatment, particularly its age hardening characteristics.

The addition of boron to the alloy increases its hardness and corrosion resistance.

In the particle dispersion-strengthened alloy of this invention, it is essential that the amounts of Ni, Si, Sn, Fe and B be limited to the following specific ranges.

The nickel content of the alloy of this invention must be in the range from 0.1 to 10% by weight. A nickel content greater than 10% causes the alloy to have poor elongation, and thus poor workability. A nickel content of less than 0.1% results in poor corrosion resistance of the alloy. For obtaining a most suitable combination of strength and elongation, it is preferable that the nickel content of the alloy be in the range from 5 to 8% by weight.

The tin content of the alloy of this invention must be in the range from 0.1% to 10% by weight. The presence of tin in the alloy imparts elasticity, stress resistance, corrosion resistance, soldering ability and plating ability to the alloy. A tin content greater than 10% causes a reduction in the elongation characteristics of the alloy, and also tends to cause a reduction in electrical conductivity. A tin content of less than 0.1% by weight is insufficient, particularly for the purpose of obtaining the desirable properties which are characteristic to a spinodal alloy. More preferably, the alloy of this invention should contain 5% to 10% by weight of tin.

The silicon content of the alloy of this invention must be in the range from 0.05% to 5% by weight. A silicon content of more than 5% by weight results in poor workability accompanied by an impairment of mechanical properties and electrical conductivity. A silicon content of less than 0.05% by weight is insufficient, particularly for obtaining the desirable properties associated with the formation of the Ni-Si intermetallic compound homogeneously dispersed in the alloy. More preferably, the silicon content should be in the range of 0.1% to 2% by weight.

The iron content of the alloy of this invention must be in the range from 0.01% to 5% by weight. An iron content greater than 5% by weight results in poor electrical conductivity and corrosion resistance. An iron content of less than 0.01% is insufficient, particularly for obtaining the age hardening and particle characteristics of the alloy. More preferably, the iron content should be in the range from 0.1% to 2% by weight.

The boron content of the alloy of this invention must be in the range from 0.0001% to 1% by weight. Boron contributes to improving the corrosion resistance, hardness and strength of the alloy. A boron content greater than 1% by weight results in poor workability. A boron content of less than 0.0001% is insufficient for achieving the desirable properties associated with the presence of boron. The boron content is preferably in the range from 0.001% to 0.1% by weight. In general, a boron content of 0.002% by weight is most preferable.

The properties of the alloy of this invention may be widely modified by adjusting the amounts of the components, in particular the amounts of Ni, Si, and B, within the above described ranges.

The alloy of this invention has excellent heat resistance characterized by sustained strength after continuous exposure to high temperatures. The presence of the intermetallic Ni-Si compound in the alloy, and the solid solution characteristics of the alloy have the effect of improving its hardening characteristics. The age hardening and precipitation hardening of the alloy of this invention take place at a tempering temperature of 400° to 450° C., and result in a high hardness.

The alloy of this invention is further described in the following examples which are only illustrative and to which the invention is in no way limited.

EXAMPLES

A particle dispersion-strengthened copper alloy according to this invention was prepared from the following components:

| | | |
|---|---|---|
| Nickel | 5% | by weight |
| Tin | 5% | " |
| Silicon | 0.8%–1.0% | " |
| Iron | 0.4%–0.5% | " |
| Boron | 0.002% | " |
| Copper | balance. | |

A melt of copper, nickel, iron and boron was first prepared, at a melting temperature of 1,300° C. Then, silicon was added to the melt for deoxidation. Next, the temperature was lowered and tin was added to the melt. A particle dispersion-strengthened alloy was thus obtained, which had a melting point of 1,100° to 1,200° C.

Copper alloys were prepared in the same manner as described above. Their compositions and physical properties are shown in the following table. The physical properties were measured after heating a plate of the alloy (having a thickness of 2 mm) to 850° C. for 1 hour and water quenching, then effecting 50% reduction at room temperature. Thereafter, tempering at 400° C. was carried out for 2 hours.

TABLE

| | | | | | | Physical and mechanical properties | | | | |
|---|---|---|---|---|---|---|---|---|---|---|
| Ni % | Sn % | Si % | B % | Fe % | Cu % | Tensile strength (kg/mm$^3$) | Elongation (%) | Hardness (Vickers) | Annealing (°C.) | Tempering (hrs) |
| 5.3 | 4.3 | 0.8–1.6 | 0.002 | 0.4 | bal. | 70–93 | 5–11 | 270–310 | 800–850 | 2 |
| 5.0 | 5.0 | 0.8–1.5 | 0.002 | | bal. | 80 | 4–8 | 281 | 800–850 | 2 |
| 4.9 | 4.68 | 0.8–1.76 | 0.002 | | bal. | 75 | 5 | 280 | 800–850 | 2 |

The particle dispersion-strengthened copper alloy of this invention has good electrical conductivity, heat conductivity, strength, hardness, plating ability, soldering ability, elasticity, and excellent corrosion resistance including resistance to acids.

The properties of the copper alloy of this invention may be modified by changing the proportions of the components of the alloy, as well as changing the heat treatment conditions. For example, it is possible to obtain a copper alloy which has a tensile strength of 120 kg/mm$^3$, an elongation of 3–5%, and a hardness of 380–400 (Vickers) by preparing an alloy according to this invention having a Ni content of 5.3% by weight, a Sn content of 4.3% by weight, and a Si content of 0.8–1.6% by weight, and then water quenching the alloy after heating to 850° C. for 1 hour, and effecting a reduction rate of 75–80% at room temperature.

The particle dispersion-strengthened copper alloy of this invention is particularly suitable for use in electronic parts such as relays, lead frames, and connectors.

I claim:

1. A copper alloy consisting essentially of:

(1) copper, (2) 0.1–10% by weight of nickel, (3) 0.1–10% by weight of tin, (4) 0.05–5% by weight of silicon, (5) 0.01–5% by weight of iron, and (6) 0.0001–1% by weight of boron, wherein the amount of each of components (2)–(6) is based on the weight of the alloy, and the amount of copper constitutes the balance of the weight of the alloy said alloy containing a Ni-Si intermetallic compound homogeneously dispersed therein.

2. A copper alloy according to claim 1, wherein the amount of nickel is in the range from 5 to 8% by weight.

3. A copper alloy according to claim 1, wherein the amount of tin is in the range from 5 to 10% by weight.

4. A copper alloy according to claim 1, wherein the amount of silicon is in the range from 0.1 to 2% by weight.

5. A copper alloy according to claim 1, wherein the amount of iron is in the range from 0.1% to 2% by weight.

6. A copper alloy according to claim 1, wherein the amount of boron is in the range from 0.001 to 0.1% by weight.

7. A copper alloy according to claim 1, wherein the amount of boron is 0.002% by weight.

* * * * *